US007647010B2

(12) United States Patent
Koizumi et al.

(10) Patent No.: US 7,647,010 B2
(45) Date of Patent: Jan. 12, 2010

(54) TONER CARTRIDGE AND IMAGE FORMING APPARATUS

(75) Inventors: Hiromitsu Koizumi, Saitama (JP); Chiharu Nakajima, Saitama (JP); Takuji Matsumoto, Saitama (JP); Toyohiko Awano, Saitama (JP); Shigeki Nishimura, Saitama (JP); Mutsumi Kikuchi, Saitama (JP); Yasufumi Kayahara, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 441 days.

(21) Appl. No.: 11/604,769

(22) Filed: Nov. 28, 2006

(65) Prior Publication Data

US 2007/0253747 A1 Nov. 1, 2007

(30) Foreign Application Priority Data

Apr. 28, 2006 (JP) ..... 2006-126171

(51) Int. Cl.
*G03G 15/08* (2006.01)

(52) U.S. Cl. ..... 399/262; 399/119; 399/263

(58) Field of Classification Search ..... 399/119, 399/262, 263

See application file for complete search history.

(56) References Cited

U.S. PATENT DOCUMENTS 6,272,298 B1 * 8/2001 Yamaguchi et al. ..... 399/106
6,324,371 B1 * 11/2001 Okiyama et al. ..... 399/262
6,393,239 B1 * 5/2002 Arcaro et al. ..... 399/227

FOREIGN PATENT DOCUMENTS

JP 2001-42620 A 2/2001
JP 2003-167413 A 6/2003

* cited by examiner

*Primary Examiner*—David M Gray
*Assistant Examiner*—Benjamin Schmitt
(74) *Attorney, Agent, or Firm*—Sughrue Mion, PLLC

(57) ABSTRACT

The present invention provides a toner cartridge of replaceable type that is removably loaded into an apparatus main body, the toner cartridge including: a first section that is substantially cylindrical shape and at which a toner conveying member is disposed; and a second section that is provided at a substantially central portion in a longitudinal direction of the toner cartridge, the substantially central portion being a portion other than an upstream side in a toner conveyance direction of the first section and a downstream side in the toner conveyance direction of the first section at which a toner supply opening.

11 Claims, 12 Drawing Sheets

TONER CARTRIDGE AND IMAGE FORMING APPARATUS

BACKGROUND

1. Technical Field

The present invention relates to a toner cartridge and an image forming apparatus, and in particular, it relates to a toner cartridge for an image forming apparatus using the electrophotography system of developing an electrostatic image with a toner.

2. Related Art

Conventionally, for the image forming apparatus adopting electrophotographic system such as a copying machine and a laser printer, reduction of the number of replacements by increasing the capacity of the expendable supplies has been required in order to reduce the page cost or the like.

The toner cartridges for supplying a toner to the image forming apparatus includes a toner cartridge of a single-layer bottle type for supplying the toner to the apparatus main body by simply setting the cartridge supply opening to the receiving opening of the main body so as to adjust each other and removing the sealing member that seals the supply opening, and a toner cartridge of a plural-layer cylinder type in which the cylindrical inner case is inserted into the cylindrical outer case and the inner case is rotatable.

In the replacement of the cartridge after the toner supply, since the bottle type cartridge is detached with the toner supply opening in an open state, the residual toner inside the cartridge can easily be scattered so as to pollute the circumference or the like, which give rise to a problem of handling difficulty.

According to the cylinder type cartridge 117 of a cylindrical, plural layer structure as shown in FIG. 11, although pollution by the toner scattering or the like can be prevented by opening and closing of the supply opening by the rotation operation of the cartridge in a state of being mounted on the apparatus main body. However, for enlarging the toner capacity for meeting the demand from the users as mentioned above, since the cylindrical diameter of the cartridge 117 as shown in for example FIGS. 11, 12 should be enlarged, therefore, as the result of enlarging the toner capacity, there is a problem of enlarging also the apparatus main body.

SUMMARY

A toner cartridge according to an aspect of the invention includes a cylindrical first region provided with a toner conveying member, and a second region provided at substantially central portion in the longitudinal direction except the toner conveyance direction upstream side of the first region and the toner conveyance direction downstream side provided with a toner supply opening.

BRIEF DESCRIPTION OF THE DRAWINGS

Exemplary embodiments of the invention will be described in detail with reference to the following figures, wherein.

DETAILED DESCRIPTION

First, the outline of an image forming apparatus 10 according to the exemplary embodiment of the invention will be explained. Basic configuration FIGS. 1 to 2 show the basic configuration of the image forming apparatus according to the exemplary embodiment of the invention.

Figure 1:
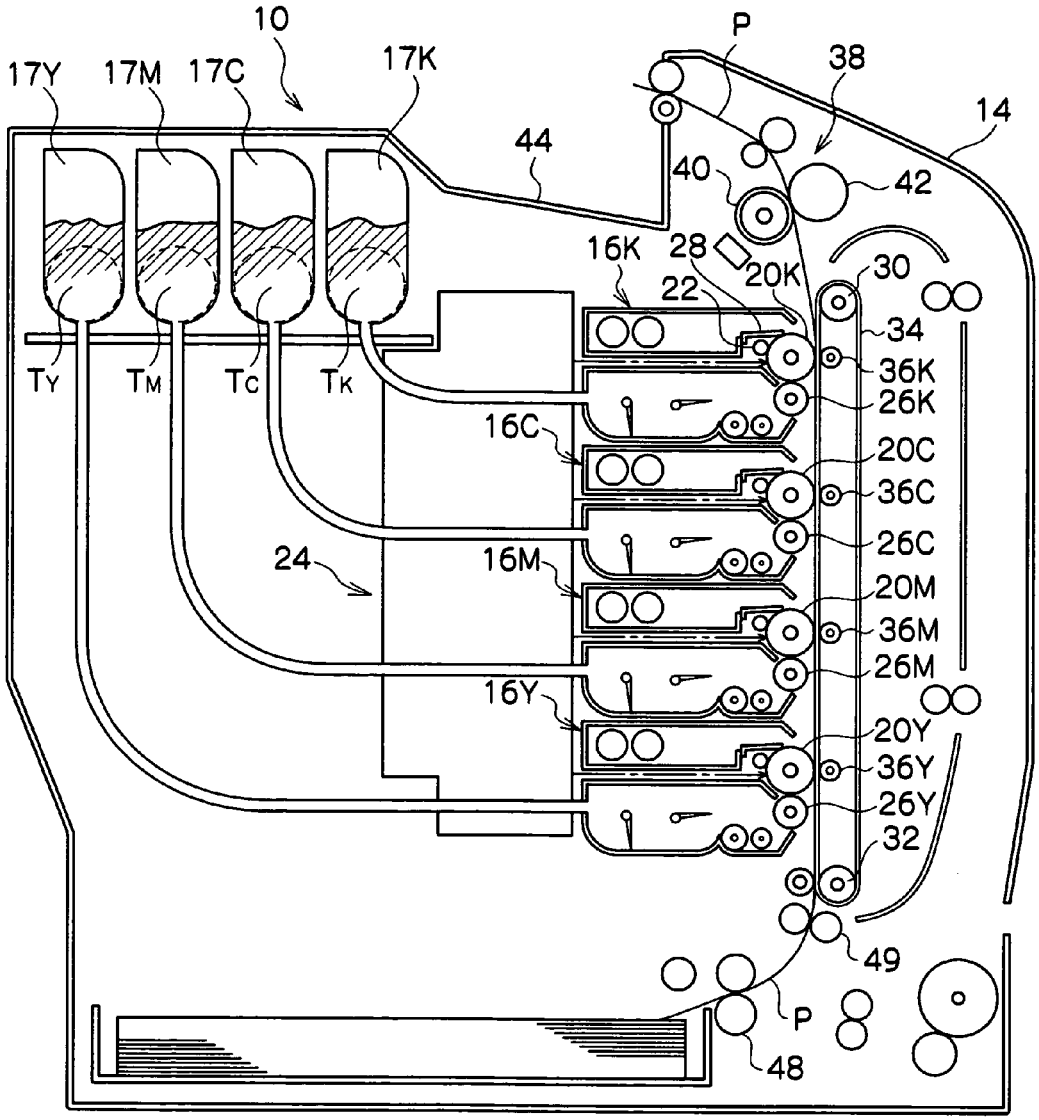
FIG. 1 is a schematic diagram showing an image forming apparatus according to the exemplary embodiment of the invention.
Figure 2:
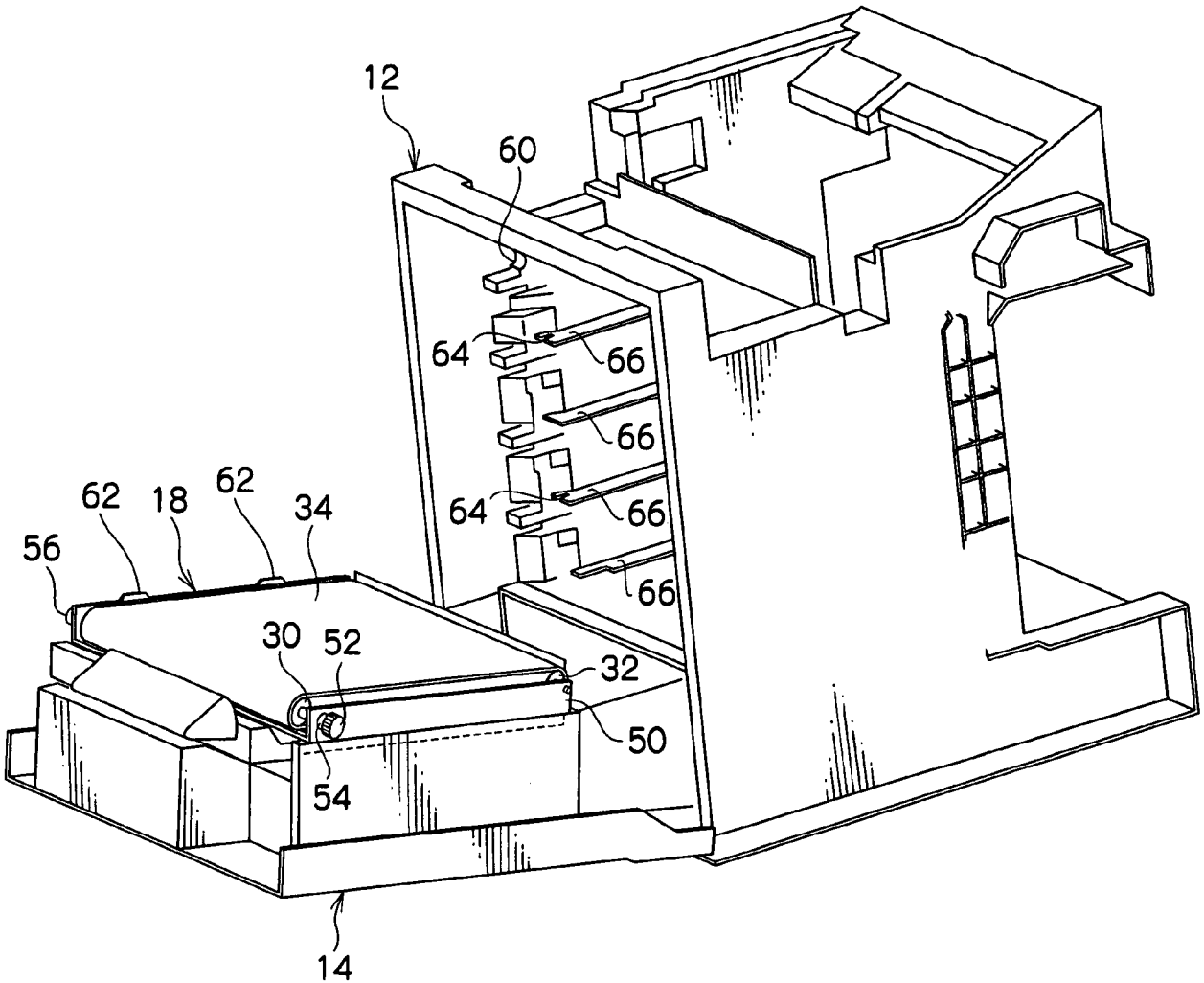
FIG. 2 is a perspective view showing an image forming apparatus according to the exemplary embodiment of the invention.

FIGS. 1 to 2 show an example of a drum type four color image forming apparatus according to the exemplary embodiment of the invention.

As shown in FIGS. 1 to 2, the image forming apparatus 10 includes a main body frame 12 that, in attachably and detachably manner, accommodates an image carrier member (photosensitive member) 20 and a developing unit 16, and a cover member 14 for opening or closing the image carrier member 20 and the developing unit 16. The cover member 14 includes a conveyance unit 18 which is attachably and detachably mounted at the cover member 14 and includes a conveyance belt 34 capable of adsorbing a recording paper P for conveying.

Note that, at the image forming apparatus 10, plural image carrier members (the photosensitive members) 20 and plural developing units 16 (and other members) are provided for the respective colors of yellow (Y), magenta (M), cyan (C) and black (K), which will be described later as "image carrier members 20Y, 20M, 20C and 20K" and "developing units 16Y, 16M, 16C and 16K". However, in order to facilitate the explanation, there may be cases where "Y", "M", "C" and "K" are omitted from the respective reference numerals in the following explanation.

Each developing unit 16 includes a charge roller 22 that uniformly charges the surface of the roll-like image carrier member 20, an optical box 24 that forms a latent image by the electrostatic potential difference by irradiating an image beam to the image carrier member 20 on the basis of image data, a developing roller 26 that visualizes the latent image by selectively transferring a toner thereto, and a cleaning member 28 that slides against the image carrier member 20 after transferring of the toner image for cleaning the residual toner on the image carrier member 20.

The image carrier member 20 includes a photosensitive layer on the surface (circumferential surface) thereof. The electrostatic latent image (image) is formed as follows: the surface (circumferential surface) is uniformly charged by the charge roller 22; thereafter, the surface (circumferential surface) is exposed by a laser beam (image beam) irradiated from the optical box 24; and the potential of the exposed portion is attenuated. The charge roller 22 is contacted with the image carrier member 20 for charging the surface (circumferential surface) of the image carrier member 20 substantially uniformly by applying a voltage therebetween and generating electric discharge in a minute space in the vicinity of the contact portion.

The optical box 24 causes a flickering laser beam to be scanned on the surface (circumferential surface) of the image carrier member 20 so as to form an electrostatic latent image based on the image data on the surface (circumferential surface) of the image carrier member 20. As the optical box 24, one having light emitting elements such as an LED arranged for flickering based on the image data or the like can be considered.

The developing roller 26 is disposed facing the image carrier member 20 adjacently for applying a developing bias voltage between the developing roller 26 and the image carrier member 20. Thereby, a developing bias electric field is formed between the developing roller 26 and the image carrier member 20 so that a charged toner is transferred onto the exposed portion on the image carrier member 20 to form a visual image.

On the other hand, the conveyance unit 18 includes a conveyance belt 34 laid across at least a driving roller 30 and a driven roller 32. Plural (4 pieces; corresponding to each of colors which will be described later) transfer rollers 36 are provided at predetermined positions on the inner surface side of the conveyance belt 34 between the driving roller 30 and the driven roller 32 with predetermined intervals therebetween.

The transfer roller 36 faces the image carrier member 20 with the conveyance belt 34 interposed therebetween when the cover member 14 is closed (when the image carrier member 20 and the like is closed by rotating the cover member 14 to the main body frame 12 side). The toner image (unfixed image) on the image carrier member 20 is transferred onto the proceeding (passing) recording paper P which is adsorbed and conveyed by the conveyance belt 34 by forming a transfer electric field between the image carrier member 20 and transfer rollers 36.

Here, the developing units 16 are provided in the vertical direction in the order of for example yellow (Y), magenta (M), cyan (C) and black (K) from below along the conveyance direction of the recording paper P for allowing full color printing. A fixing device 38 is provided at the downstream side (upper part of the main body frame 12) of the recording paper P conveyance direction with respect to the developing units 16Y to 16K.

The developing units 16Y to 16K each develop an electrostatic image on the image carrier members 20Y to 20K with toners of yellow (Y), magenta (M), cyan (C) and black (K) and transfer the formed toner images onto the paper P.

Since the toners of each color Ty to Tk in the developing units 16Y to 16K are consumed by formation of the toner images, the developing process is carried out while maintaining the toner amount of each of the colors in the developing units 16Y to 16K by properly supplying the toners from toner cartridges 17Y to 17K.

The fixing device 38 includes a heat roller 40 and a pressure roller 42, facing circumferential surfaces of the heat roller 40 and the pressure roller 42 being pressed (nipped) by a predetermined pressure. By heating and pressuring an unfixed image which is transferred onto the recording paper P with the heat roller 40 and the pressure roller 42, the toner image is fixed on the recording paper P.

The recording paper P with the toner image fixed by heating and pressuring with the fixing device 38 (the heat roller 40 and the pressure roller 42) is discharged onto a paper discharge tray 44. Then, after completing transfer of the toner image onto the recording paper P, the surface (circumferential surface) of the image carrier member 20 is subject to a cleaning process with the cleaning member 28 for preparation to the next image producing process.

Moreover, a removable paper feed cassette 46 is provided in the lower part of the main body frame 12. The paper feed cassette 46 can be pulled out in the direction opposite to the feeding direction of the recording paper P so as to be able to properly supply the recording papers P.

Then, a paper feed roller pair 48 for feeding out the recording papers P one by one from the paper feed cassette 46 is provided in the vicinity of the top end portion of the paper feed cassette 46 so that the recording paper P fed out from the paper feed roller pair 48 is sent out to the adsorb conveyance surface of the conveyance belt 34 by a resist roller pair 49 by a predetermined timing so as to be transported to a transfer position of each color toner image.

The conveyance unit 18 to be mounted removably on the cover member 14 in the image forming apparatus 10 of the configuration mentioned above will be explained in further details.

The conveyance unit 18 includes a substantially rectangular frame-like housing 50. In the housing 50, the driving roller 30 is rotatably supported on one end part (an upper end part), and the driven roller 32 is rotatably supported on the other end part (a lower end part). Then, the conveyance belt 34 for electrostatically adsorbing the recording paper P is wound around and laid across the driving roller 30 and the driven roller 32.

Moreover, the transfer rollers 36Y to 36K are provided between the driving roller 30 and the driving roller 32 at the inner surface side of the conveyance belt 34 with a predetermined intervals therebetween for each of the colors. Each of the transfer rollers 36Y to 36K is rotatably supported in the housing 50. The transfer rollers 36Y to 36K are pressed against the respective image carrier members 20Y to 20K by a predetermined pressure with the conveyance belt 34 being sandwiched between the transfer rollers 36Y to 36K and the image carrier members 20Y to 20K when the cover member 14 is closed. The respective transfer rollers 36Y to 36K are rotated according to running of the conveyance belt 34.

Toner Cartridge

FIGS. 3A, 3B, 4A, 4B, 5 and 6 show a toner cartridge for an image forming apparatus according to the exemplary embodiment of the invention.

Figures 3A, 3B:
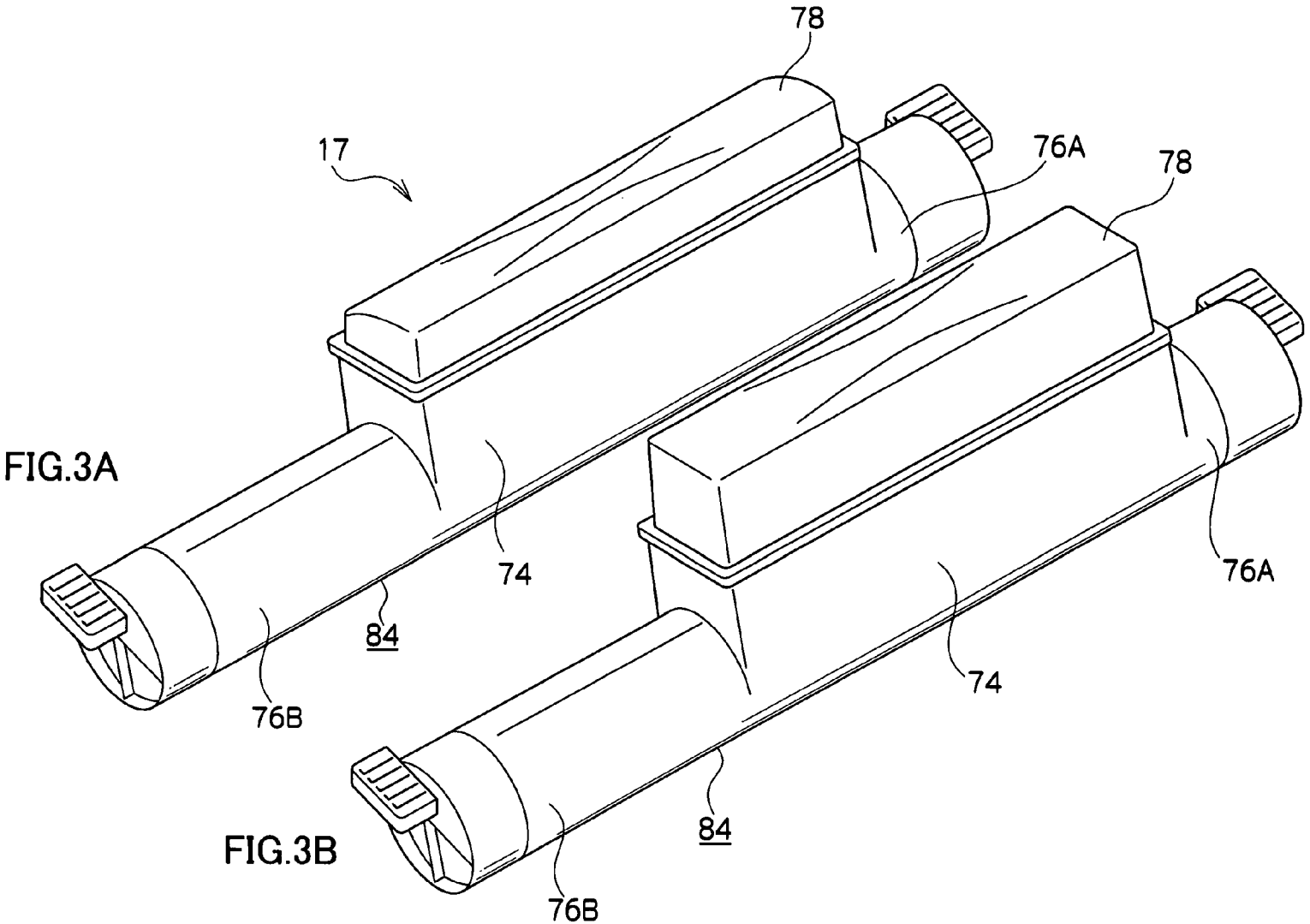
FIG. 3A is a perspective view showing a toner cartridge according to the exemplary embodiment of the invention.
FIG. 3B is a perspective view showing a toner cartridge according to the exemplary embodiment of the invention.

As shown in FIGS. 3A and 3B, the toner cartridge 17 according to the exemplary embodiment of the invention includes three blocks of a central part 74, and projecting parts 76A and 76B. The central part 74 includes an upper portion in a substantially rectangle shape, and the cylindrical projecting parts 76A and 76B and a lower portion of the central part 74 are formed continuously and integrally.

The central part 74 (the upper portion of the central part 74) is a space for accommodating the toner T, and the capacity of the central part 74 for a toner of a color with a small consumed amount is restrained as shown in FIG. 3A, and the capacity of the central part 74 for a toner of a color with a large consume amount, such as the K color is increased as shown in FIG. 3B, so as to be able to correspond to the toner capacity change (the toner consumed amount). At this time, since, by changing only the size of a cover member 78 which is provided at the upper portion of the central part 74, the other members can be used commonly, cost reduction can be realized while ensuring the capacity.

Figure 4A:
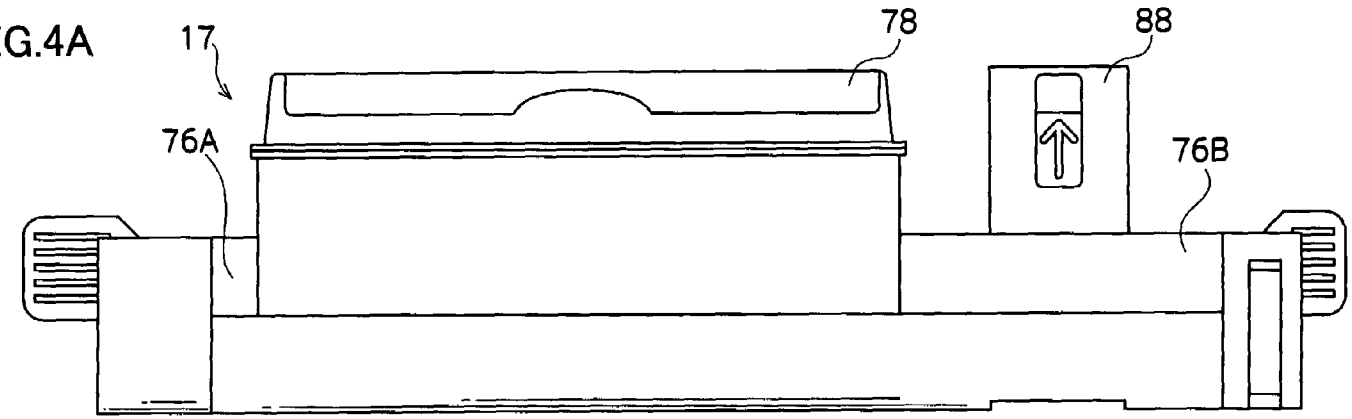
FIG. 4A is a diagram showing a toner cartridge according to the exemplary embodiment of the invention.
Figure 4B:
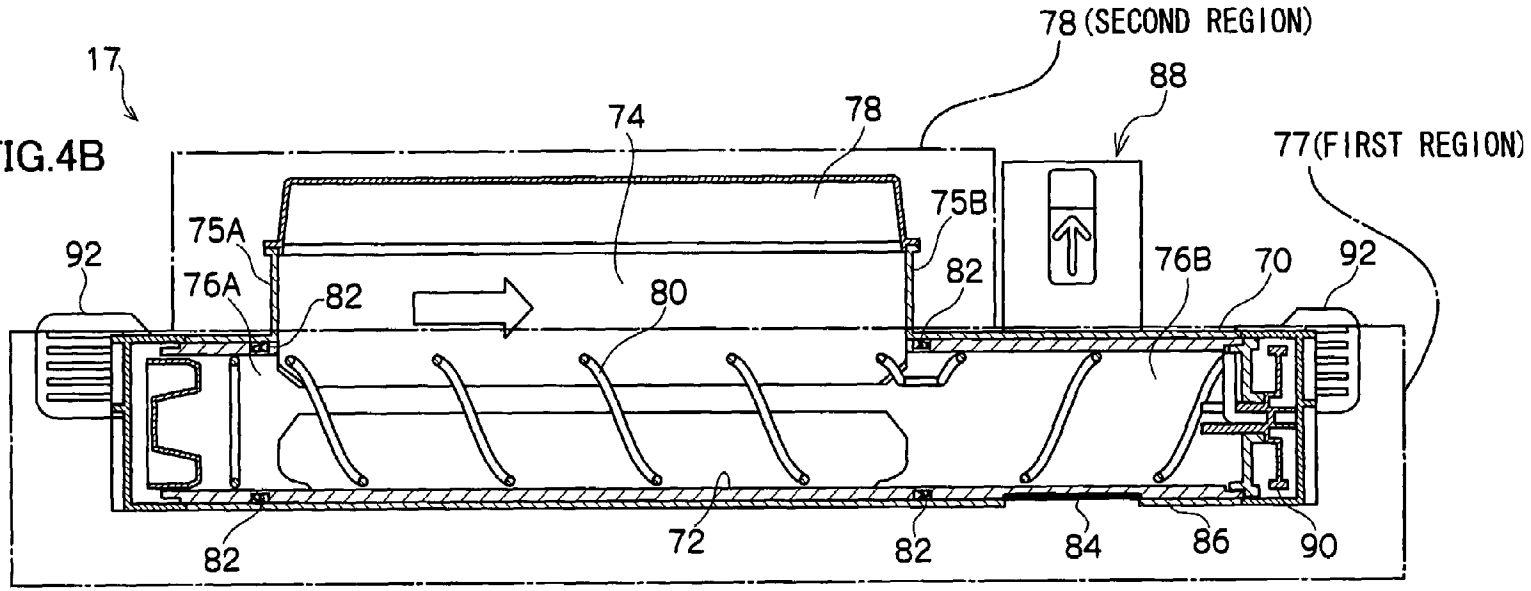
FIG. 4B is a diagram showing a toner cartridge according to the exemplary embodiment of the invention.

FIGS. 4A and 4B show the external appearance and the internal structure of the toner cartridge 17.

As shown in FIG. 4B, the toner cartridge 17 has a structure in which a substantially cylindrical inner housing 72 is fitted into an outer housing 70. By rotating a spiral toner conveying member 80 provided inside the inner housing 70 by an unshown external power via a driving gear 90, the toner T in the central part 74 is conveyed toward a toner supply opening 84 which is provided in the outer housing 70 as shown by the white arrow in the figure.

As shown in FIG. 4B, the toner cartridge 17 includes a cylindrical part 77 (a first section) having a substantially cylindrical shape for conveying and supplying the toner T into the developing unit 16 of the image forming apparatus 10, and an extension part 79 (a second section) added for ensuring the capacity of the toner cartridge 17 to increase the amount of the toner T as described above.

Figure 5:
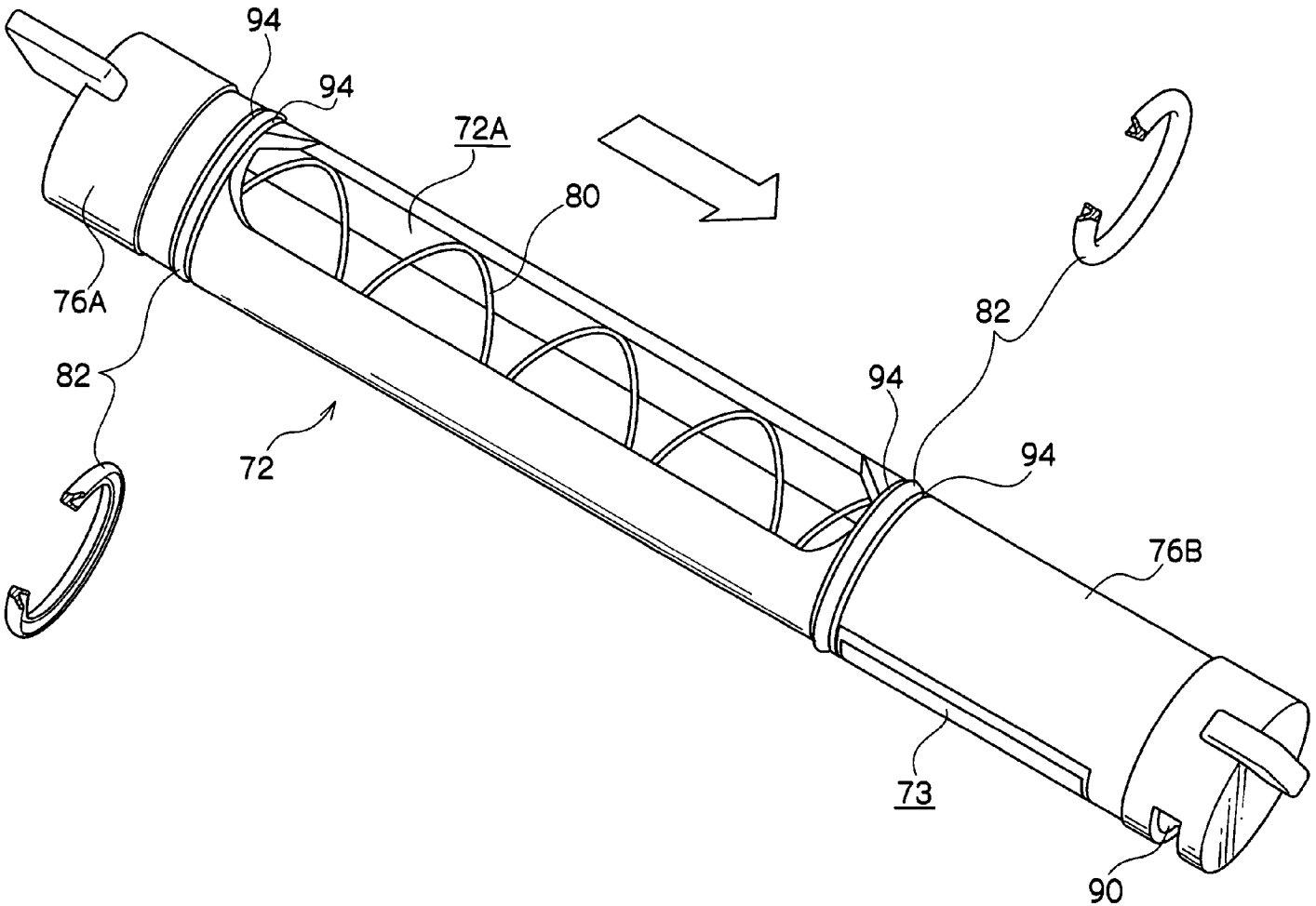
FIG. 5 is a perspective view showing an inner housing of a toner cartridge according to the exemplary embodiment of the invention.
Figure 6:
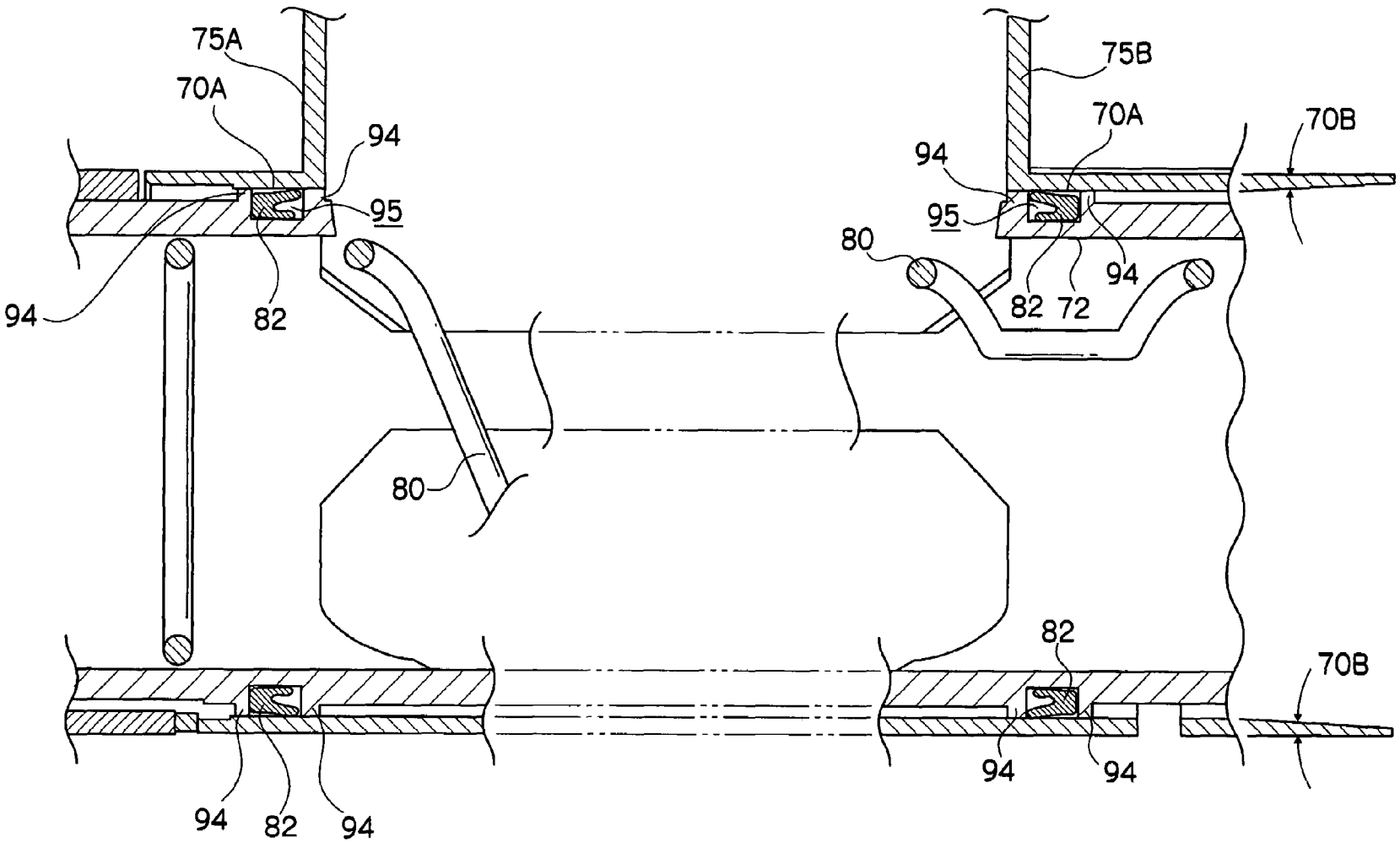
FIG. 6 is an enlarged view showing a toner cartridge according to the exemplary embodiment of the invention.

FIGS. 5 and 6 show the structure of the inner housing 72 to be inserted into the outer housing 70.

As shown in FIG. 5, the inner housing 72 is a substantially cylindrical shape. The toner in the central part 74 of the outer housing 70 is conveyed, from the opening part 72A, by the toner conveying member 80, and the toner is transferred out from the toner supply opening 73. Positioning is carried out between the outer housing 70 and the inner housing 72 by butting (abutting) each of projecting parts 94 provided in the inner housing 72 against a butting surface 70A of an inner wall of the housing 70 at positions corresponding to respective boundary walls 75A and 75B of the central part 74 of the outer housing 70.

As mentioned above, by disposing a position of the boundary wall 75B (at the toner supplied opening 73 side) on the toner conveyance direction upstream side (left side in the figure) with respect to the toner supply opening 84, the central part open region of the inner housing 72 necessary for providing a large capacity of toner can be made smaller and at the same time rigidity insufficiency of the inner housing 72 due to the opening part 72A as a toner supplied opening can be compensated.

As shown in FIG. 6, two pairs of two projecting parts 94 are provided a ring-like V-shaped sealing members 82 having a V-shaped cross-section are provided in respective gaps 95 formed between the projecting parts 94 so as to prevent leakage of the toner T to the outside. Moreover, since the cross-section of the V-shaped sealing member 82 has a V-shape, by disposing the V-shaped sealing members 82 such that the open sides of the "V" face each other, the toner T leakage can be prevented effectively. Furthermore, since they are ring-like shape, the seal nip amount can be ensured evenly across the entire circumference so as to certainly prevent the toner leakage.

That is, in a case of storing the cartridge at a low temperature of about −20° C., for example, in order to prevent leakage of the toner T, a stroke (nip amount) of about 0.6 mm is necessary in consideration of the allowance of the constituent members. Furthermore, the rotational torque of a handle, which is operated by the user, should be ensured to 1.3 Nm or less as a proper value. For example, if a simple O ring is used as the sealing member, in consideration to the rotational torque of the handle, since the nip amount is only ensured by about 0.1 mm, therefore the parts accuracy can hardly be ensured with the allowance being taken into consideration. If the nip amount is increased, since the rotational torque becomes heavier due to the nip pressure increase, so increasing the toner leakage risk. Accordingly, the V-shaped sealing member 82 capable of ensuring the stroke without the nip pressure increase is used.

Moreover, at the time of transporting the cartridge by an airplane, toner in the inside of the cartridge may be leaked due to the pressure reduction. However, by disposing the open sides of the V-shape facing with each other, they can be deformed to the direction of increasing the nip amount when the internal pressure is increased. Thereby, a structure capable of enduring a pressure reduction test (0.4 atmospheric pressure) assuming the case of the transportation of the cartridge by the airplane can be provided so as to prevent leakage of the toner T effectively.

The toner conveying member 80 for conveying the toner T is driven by the external power via the gear 90. The toner T dropped from the opening part 72A to the inner housing 72 is transported in the white arrow direction in the figure, and the toner T is supplied from the toner supply opening 73 to the apparatus main body.

The inner housing 72 inserting side of the outer housing 70 has a taper shaped cross-section with the plate thickness gradually thinned.

The inner housing 72 is inserted into the outer housing 70 from the toner supply opening 84 side of the outer housing 72. Since the butting surface 70A as an inner surface of the band-like complete round region of the outer housing 70 has a bearing structure (a shaft-supporting structure), draft is not provided. However, since the inner diameter of the inner surface of the outer housing 70 from an end portion of the butting surface 70A to a longitudinal direction end (a toner supply opening 84 side end) increases toward a direction opposite to the inserting direction of the inner housing 72 so as to have a tapered cross-section as shown by 70B of FIG. 6, it can provide the effects of preventing turning up of the V-shaped sealing member 82 by catching at the time of inserting the inner housing 72 and facilitating pulling out from a die at the time of molding.

Mounting Operation

Figure 7A:
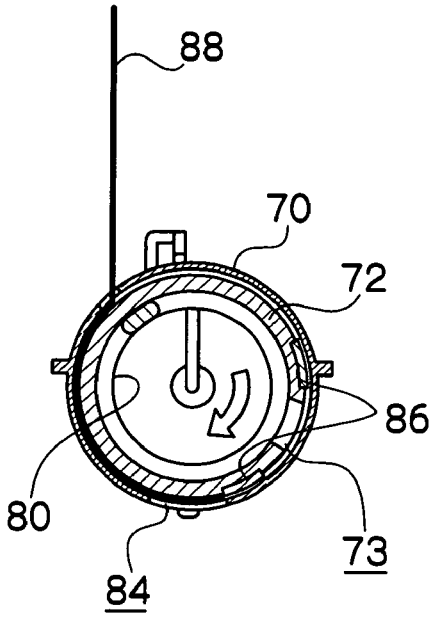
FIG. 7A is a cross-sectional view showing the operation of a toner cartridge according to the exemplary embodiment of the invention.
Figure 7B:
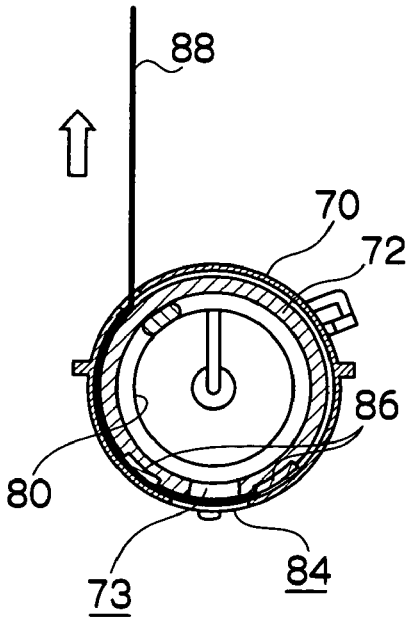
FIG. 7B is a cross-sectional view showing the operation of a toner cartridge according to the exemplary embodiment of the invention.

FIGS. 7A, 7B show the operation at the time of mounting the toner cartridge of the image forming apparatus according to the exemplary embodiment of the invention.

As shown in FIG. 7A, in the toner cartridge 17 according to the invention, a position of the toner supply opening 73 provided in the inner housing 72 is shifted from a position of the toner supply opening 84 provided in the outer housing 70 at the stage before mounting. Since they do not communicate with each other, the toner T in the central part 74 of the outer housing 70 cannot be leaked out. Moreover, a sealing member 86 is provided on the both sides of the toner supply opening 84 for preventing leakage of the toner T.

First, at the time of mounting it on the main body, by twisting (rotating) a handle 92, the inner housing 72 is rotated clockwise in the figure for allowing communication of the toner supply openings 73 and 84 so that the inside toner T can be supplied from the toner supply openings 73 and 84 to the apparatus main body. At this stage, since a heat seal 88 is thermally fused onto the inner housing 72 for closing the gap between the toner supply openings 73 and 84, toner T leakage cannot be occurred.

Subsequently, as shown in FIG. 7B, after mounting the toner cartridge 17 on the apparatus main body, by pulling out the heat seal 88 provided in the inner housing 72 in the white arrow direction in the figure, the heat seal 88 closing the gap between the toner supply openings 73 and 84 is discharged to the outside of the toner cartridge 17 for allowing communication of the toner supply openings 73 and 84, therefore, the inside toner T is supplied from the toner supply openings 73 and 84 into the apparatus main body.

Capacity Adjustment

Figure 8A:
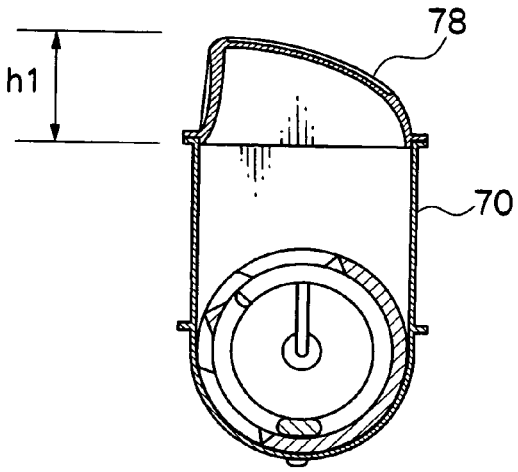
FIG. 8A is a cross-sectional view showing a toner cartridge of the exemplary embodiment of the invention.
Figure 8B:
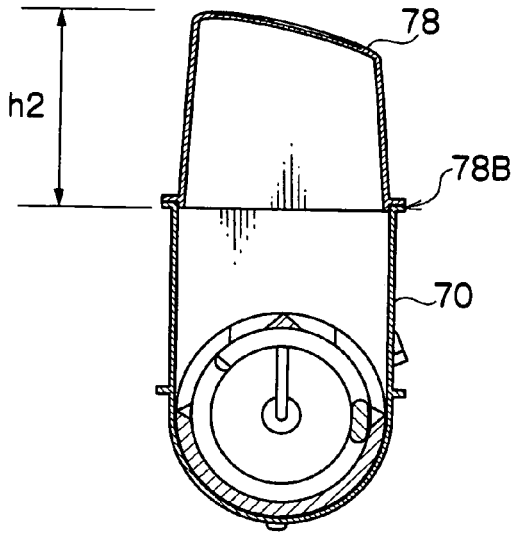
FIG. 8B is a cross-sectional view showing a toner cartridge of the exemplary embodiment of the invention.

FIGS. 8A and 8B show a cross-section of the toner cartridge of the image forming apparatus according to the invention.

As shown in FIGS. 8A and 8B, the toner cartridge 17 according to the exemplary embodiment of the invention can easily change of the capacity of the toner cartridge according to the necessary amount of the toner.

That is, in the case of a four color full color printer for the office use or the like, the toners of the three colors of Y, M, C, are not consumed so much. On the other hand, as to the K color toner that is consumed mainly for monochrome printing or character printing, if increase of the toner cartridge 17 capacity is not performed, it is not practical to use it because cartridge replacement for toner supply is needed frequently.

Then, as shown in FIG. 8B, since the other members can be used commonly by changing only the size of the cover member 78 provided at the upper portion of the central part 74, cost reduction can be achieved while ensuring the capacity.

Thereby, for example, by using the cover member 78 of a height h1 for the toner cartridges 17 for the Y, M, C three colors as shown in FIG. 8A and using the cover member 78 of a height h2 for the toner cartridge 17 for the K color, the toner capacity of the toner cartridge can be changed according to the toner necessary amount while using the other parts commonly.

At this time, by connecting the joint part 78B of the outer housing 70 and the cover member 78 by for example ultrasonic welding, a further highly reliable toner cartridge 17 can be provided at a low cost.

Prevention of Aggregation

Figure 9:
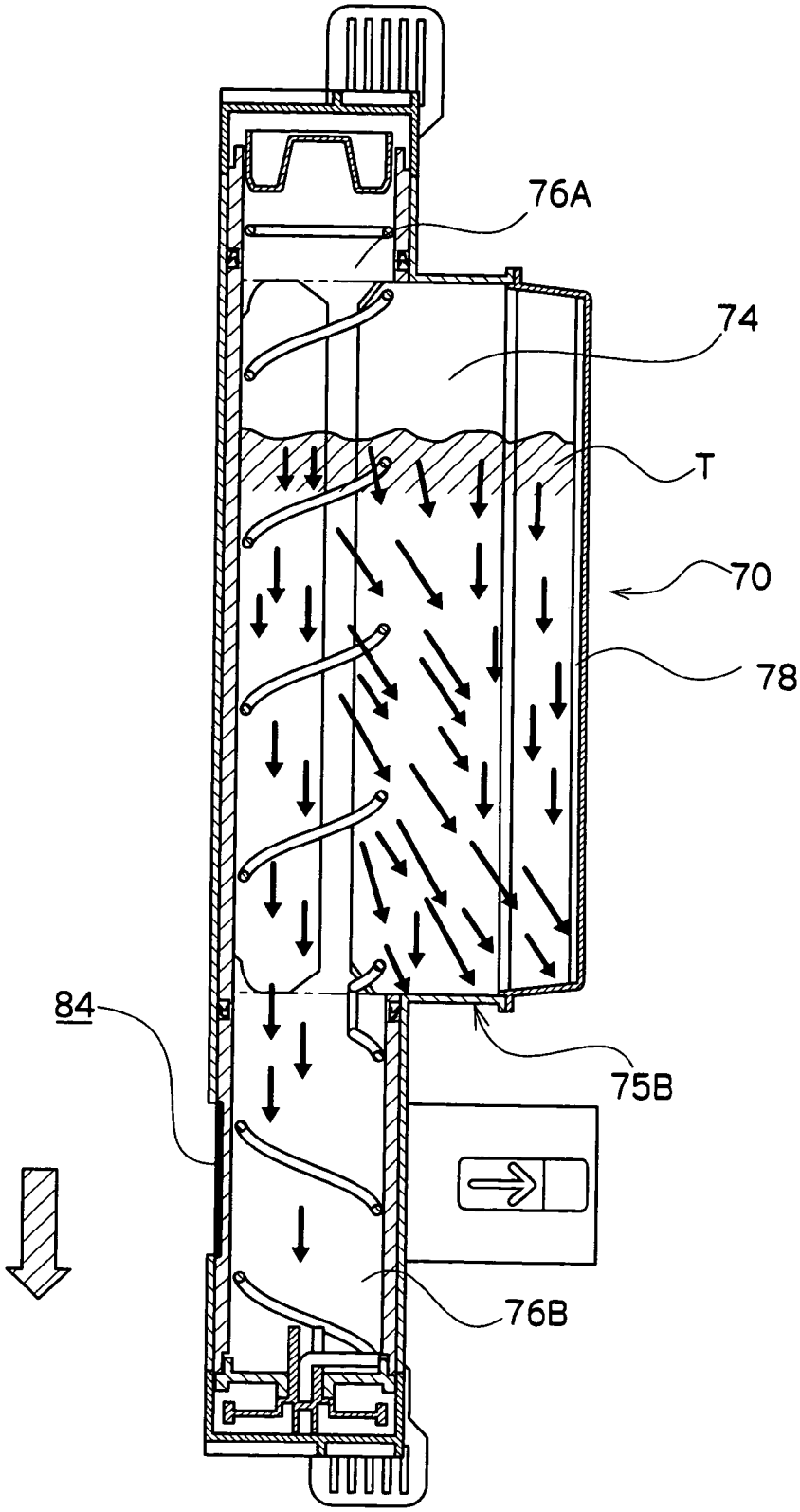
FIG. 9 is a cross-sectional view showing the toner movement inside a toner cartridge according to the exemplary embodiment of the invention.

FIG. 9 shows a cross-section of the toner cartridge of the image forming apparatus according to the exemplary embodiment of the invention.

At the time of transporting of the toner cartridge 17, a case is considered that the toner cartridge is held and carried with the projecting part 76B, on the side at which the toner supply opening 84 is provided, being downward.

At this time, as shown in FIG. 9, the flow in the direction shown by the arrow in the figure is generated in the toner T inside. That is, the toner T inside starts to be condensed in the gravity direction by the minute vibration when the toner cartridge is transported. However, since the toner T tends to flow toward a larger area, if the projecting part 76B is disposed downward, the toner T can easily be moved to the large area portion (right side in the figure) at the upper side (the central part 74) further than the projecting part 76B, that is, at the upper side further than the boundary wall 75B portion (at the central part 74). Accordingly, excessive condensation of the toner can be prevented in the projecting parts 76A and 76B.

For obtaining the above-mentioned effect, when the cross-section of the central part 74 is A, the cross-section of the projecting part 76A is B, and the cross-section of the projecting part 76B is B', in the case of B>A<B', or B=A=B', there is no such effect. In the case in which the cross-sections of the projecting parts 76A and 76B smaller than the central part 74, that is, B<A>B', the toner excessive condensation can be prevented at the time of being transported the toner cartridge held vertically.

Moreover, also in the case the toner condensation of not so much excessive is occurred, since the toner conveying member 80 is provided at the projecting parts 76A and 76B side (left side in the figure), load per unit area applied to the toner conveying member 80 can be made smaller so as to realize dramatic reduction of the rotational load torque compared with the case of providing the same on the large cross-section side (right side in the figure).

Size Down

Figure 10A:
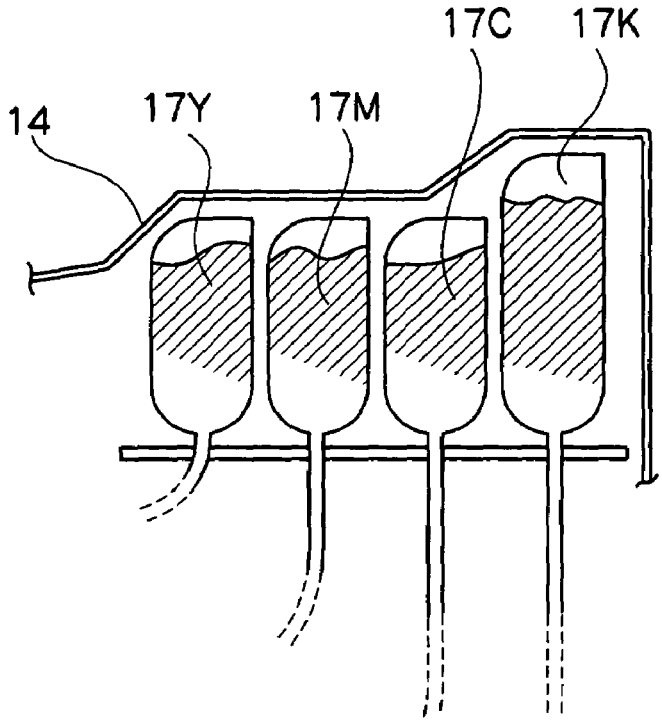
FIG. 10A is a diagram showing arrangement of a toner cartridge according to a second exemplary embodiment of the invention.
Figure 10B:
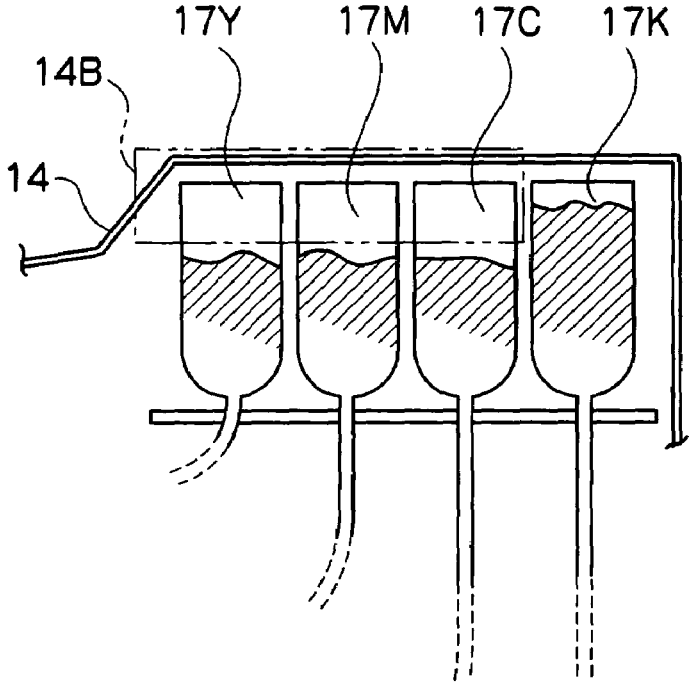
FIG. 10B is a diagram showing arrangement of a toner cartridge according to a second exemplary embodiment of the invention.
Figure 11:
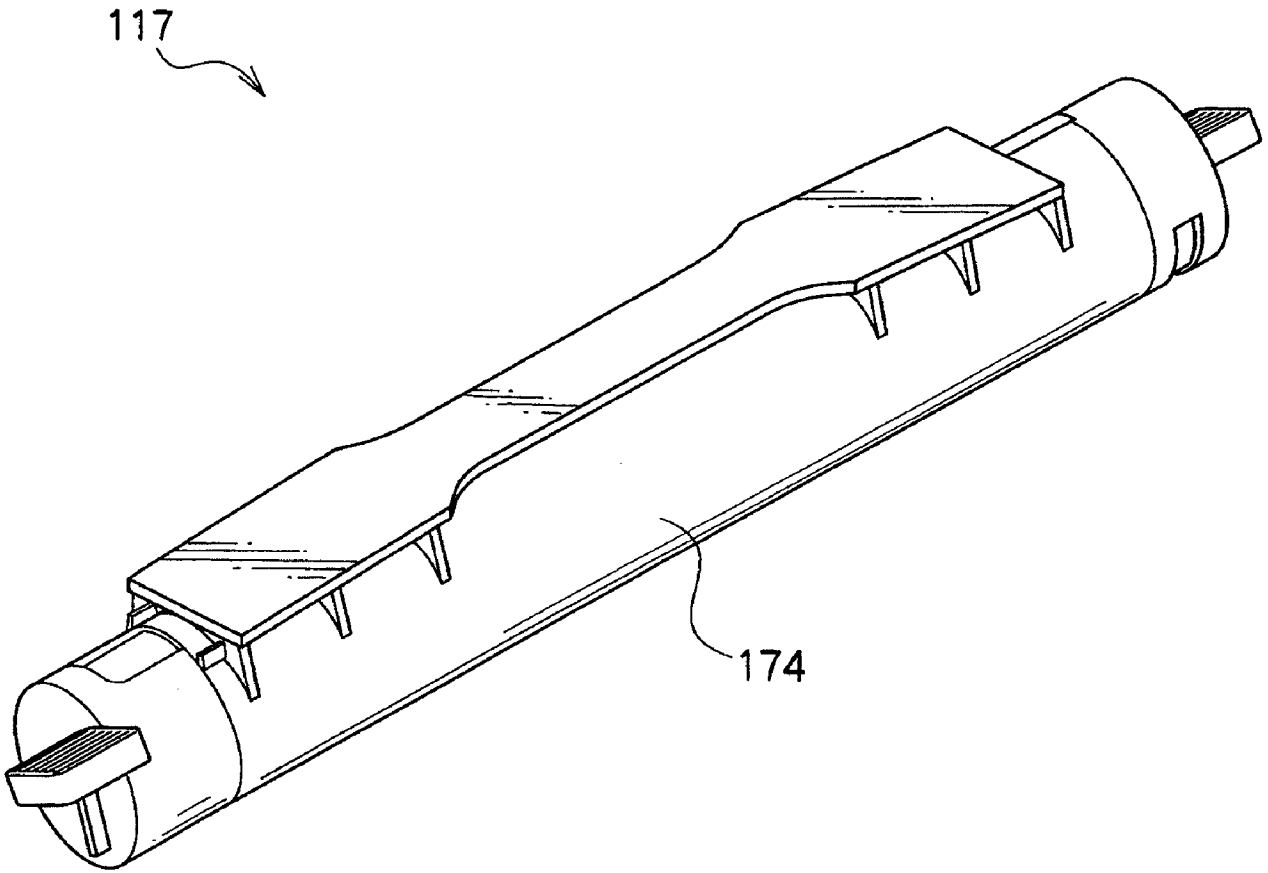
FIG.11 RELATED ART
FIG. 11 is a diagram showing a conventional toner cartridge.
Figure 12:
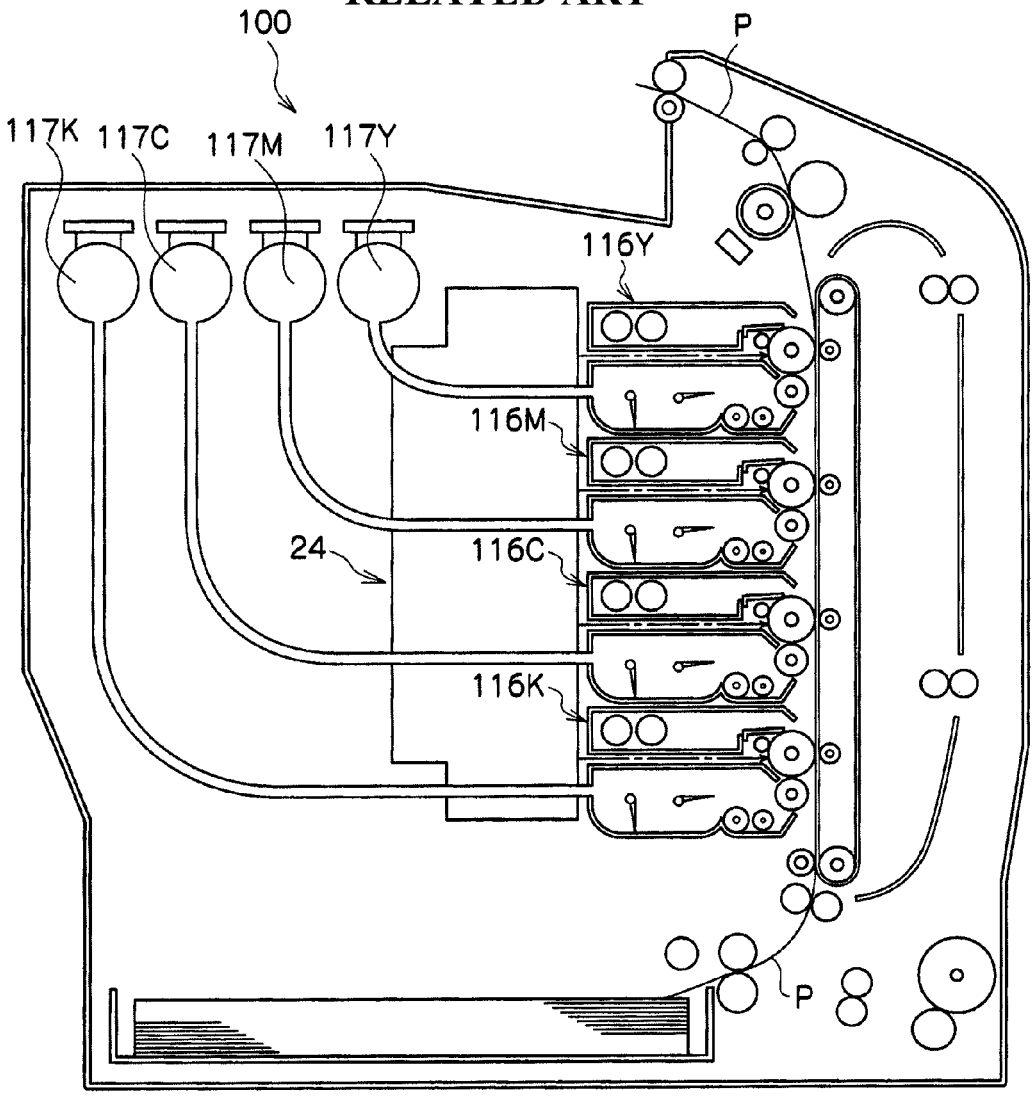
FIG.12 RELATED ART
FIG. 12 is a diagram showing an image forming apparatus using the conventional toner cartridge.

FIGS. 10A and 10B show a part of the image forming apparatus according to a second exemplary embodiment of the invention.

As shown in FIGS. 8A and 8B, the toner cartridge 17 according to the embodiment can easily vary the capacity according to the inside toner necessary amount. That is, since the other parts can be used commonly by only changing the size of the cover member 78 provided at the upper portion of the central part 74, cost reduction can be achieved while ensuring the capacity as described above.

As shown in FIG. 10B, by providing the toner cartridges 17 of each of colors by the same size, a dead space 14B is formed inside the cover member 14 so as to deteriorate the space efficiency.

On the other hand, as shown in FIG. 10A, by using the toner cartridges 17 having a small capacity for the Y, M, C three colors and using the toner cartridge 17 having a large capacity for the K color of a large use amount, the storage portion of the toner cartridge 17 can be cut back as much as possible for eliminating the dead space so that the apparatus as a whole can be downsized.

Others

The invention is not limited to the above-mentioned exemplary embodiments.

For example, although the case of a toner cartridge for the electrophotography has been explained in the above-mentioned exemplary embodiments, it is not limited thereto. The invention can be applied to a product of another system having a configuration of supplying minute powders from a storage container.

What is claimed is:

1. A toner cartridge of replaceable type that is removably loaded into an apparatus main body, the toner cartridge comprising:

a first section that is substantially cylindrical shape and at which a toner conveying member is disposed; and a second section that is provided at a substantially central portion in a longitudinal direction of the toner cartridge, the substantially central portion being a portion other than an upstream side in a toner conveyance direction of a portion of the first section and a downstream side in the toner conveyance direction of the first section at which a toner supply opening is disposed wherein:

the toner cartridge includes an outer housing and an inner housing that is substantially cylindrical shape and is inserted into the outer housing;

the first section includes the inner housing and a cylindrical portion of the outer housing; the second section includes a protruding portion of the outer housing; and an opening is formed at the inner housing at a portion corresponding to the second section.

2. The toner cartridge of claim 1, wherein:

pairs of ring-like projecting parts are respectively provided at the inner housing at the upstream side in the toner conveyance direction with respect to the opening and at the downstream side in the toner conveyance direction with respect to the opening;

the ring-like projecting parts contact an inner surface of the cylindrical portion of the outer housing to support the inner housing; and ring-like sealing members are sandwiched between the projecting parts of the respective pairs, the ring-like sealing members abutting the inner surface of the cylindrical portion of the outer housing.

3. The toner cartridge of claim 1, wherein a cover member is integrally provided in an upper portion of the protruding portion of the outer housing.

4. The toner cartridge of claim 3, wherein a toner capacity of the toner cartridge can be changed by changing the height of the cover member.

5. The toner cartridge of claim 2, wherein the sealing members are seamless ring-shaped elastic members having a substantially V-shaped cross-section.

6. The toner cartridge of claim 5, wherein the two sealing members are disposed such that open end sides of the substantially V-shaped cross-sections face each other.

7. The toner cartridge of claim 1, wherein, at an end portion of the cylindrical portion of the outer housing, from which end portion the inner housing is inserted, an inner diameter of the cylindrical portion is increased along a direction opposite to an inserting direction of the inner housing such that the end portion of the cylindrical portion of the outer housing has a tapered cross-section.

8. The toner cartridge of claim 1, wherein the protruding portion of the outer housing has a substantially rectangular parallelopiped shape.

9. A toner cartridge of replaceable type that is removably loaded into an apparatus main body, the toner cartridge comprising:

a first section that is substantially cylindrical shape and at which a toner conveying member that conveys a toner is disposed; and a second section that is provided so as to protrude, in a direction perpendicular to a toner conveyance direction, from a substantially central portion in a longitudinal direction of the first section, the substantially central portion being a portion other than an upstream side in the toner conveyance direction of a portion of the first section and a downstream side in the toner conveyance direction of the first section at which a toner supply opening from which the toner is supplied is disposed wherein:

the toner cartridge includes an outer housing and an inner housing that is substantially cylindrical shape and is inserted into the outer housing;

the first section includes the inner housing and a cylindrical portion of the outer housing; the second section includes a protruding portion of the outer housing; and an opening is formed at the inner housing at a portion corresponding to the second section.

10. The toner cartridge of claim 9, wherein pairs of ring-like projecting parts are respectively provided at the inner housing at the upstream side in the toner conveyance direction with respect to the opening and at the downstream side in the toner conveyance direction with respect to the opening.

11. An image forming apparatus comprising: an image carrier on which a latent image is formed based on image data;

a first developing section that transfers a toner of a first color onto the latent image on the image carrier;

a second developing section that transfers a toner of a second color onto the latent image on the image carrier;

a first toner cartridge that supplies the toner of the first color to the first developing section; and a second toner cartridge that supplies the toner of the second color to the second developing section, a toner capacity of the second toner cartridge being different from that of the first toner cartridge, wherein each of the first toner cartridge and the second toner cartridge comprises;

a first section that is substantially cylindrical shape and at which a toner conveying member is disposed; and a second section that is provided at a substantially central portion in a longitudinal direction of the toner cartridge, the substantially central portion being a portion other than an upstream side in a toner conveyance direction of a portion of the first section and a downstream side in the toner conveyance direction of the first section at which a toner supply opening is disposed, and wherein a height of the second section of the first toner cartridge is different from a height of the second section of the second toner cartridge.

* * * * *